US010933510B2

(12) United States Patent
Rog

(10) Patent No.: US 10,933,510 B2
(45) Date of Patent: Mar. 2, 2021

(54) ABRASIVE FLAP DISC

(71) Applicant: PRZEDSIEBIORSTWO PENTAR STANISLAW ROG, Warsaw (PL)

(72) Inventor: Stanislaw Rog, Warsaw (PL)

(73) Assignee: PRZEDSIEBIORSTWO PENTAR STANISLAW ROG, Warsaw (PL)

( * ) Notice: Subject to any disclaimer, the term of this patent is extended or adjusted under 35 U.S.C. 154(b) by 382 days.

(21) Appl. No.: 15/777,658

(22) PCT Filed: Nov. 25, 2016

(86) PCT No.: PCT/PL2016/000132
§ 371 (c)(1),
(2) Date: May 19, 2018

(87) PCT Pub. No.: WO2017/091093
PCT Pub. Date: Jun. 1, 2017

(65) Prior Publication Data

US 2018/0369993 A1 Dec. 27, 2018

(30) Foreign Application Priority Data

Nov. 27, 2015 (PL) ..... 414987

(51) Int. Cl.
*B24D 13/16* (2006.01)

(52) U.S. Cl.
CPC ..... *B24D 13/16* (2013.01)

(58) Field of Classification Search
CPC ..... B24D 13/16; B24D 11/00; B24D 11/04; B24B 37/26

(Continued)

(56) References Cited

U.S. PATENT DOCUMENTS 2,024,691 A * 12/1935 Kent ..... B24D 13/045 15/230.1
3,120,724 A * 2/1964 Mockiewicz ..... B24D 13/02 451/490

(Continued)

FOREIGN PATENT DOCUMENTS

EP 0447608 A1 9/1991
EP 2433748 A2 3/2012

*Primary Examiner* — George B Nguyen
(74) *Attorney, Agent, or Firm* — John Alumit

(57) ABSTRACT

The abrasive unit contains a carrying disc (A) with a hub (1) set off in the central zone, having a coaxial hole (2) reinforced with a steel flange sleeve (3) for mounting the abrasive unit on the spindle of the angular hand grinder. The lower edges of numerous abrasive flaps (B) are fixed with glue binders (5) on the ring surface of the near-edge zone (4), the abrasive flaps subsequently overlapping one another in the circumferential direction so that their rear edges are exposed. The wheel of the carrying disc (A) is a layered polymer composite with reinforcement consisting of at least two meshes of glass fibre situated on both frontal surfaces of the carrying disc (A). The meshes are bonded by a composite matrix containing a binder of a thermosetting synthetic resin, a fine-grained material in the form of inorganic, mineral or synthetic loose material, particularly quartz, calcareous, carbonaceous or polymineral sand, industrial or quarry dusts, blast furnace or copper slag, or a mixture of the aforementioned materials and for which the natural or crumbled grain size ranges from 0.06 to 2.0 mm and the hardness according to the Mohs scale ranges from 3 to 7.

5 Claims, 1 Drawing Sheet

Figure 1:
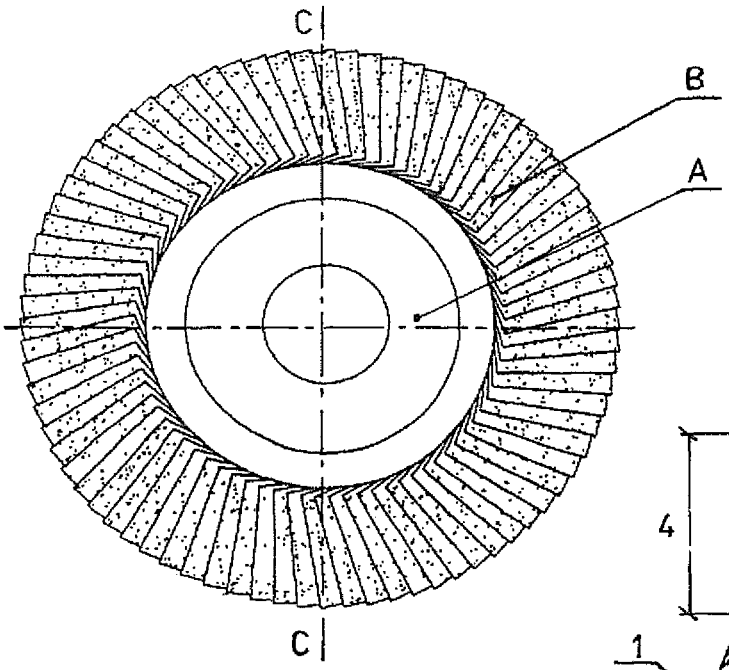

(58) Field of Classification Search
USPC ..... 451/533–539
See application file for complete search history.

(56) References Cited

U.S. PATENT DOCUMENTS

| | | | | | |
|---|---|---|---|---|---|
| 4,788,088 | A * | 11/1988 | Kohl | B29C 53/48 | 428/34.5 |
| 4,855,177 | A * | 8/1989 | Leis | B28D 1/003 | 442/26 |
| 5,231,811 | A * | 8/1993 | Andrepont | B32B 13/04 | 52/249 |
| 5,681,612 | A | 10/1997 | Benedict | | |
| 5,951,389 | A * | 9/1999 | Hettes | B24B 45/006 | 403/343 |
| 6,152,814 | A * | 11/2000 | Amarosa, Sr. | B24D 9/02 | 451/504 |
| 10,189,139 | B2 * | 1/2019 | Gacoin | B24D 9/08 | |
| 10,500,698 | B2 * | 12/2019 | Schuster | B24D 13/08 | |
| 2002/0037694 | A1 * | 3/2002 | Katsuyama | B24D 13/18 | 451/526 |
| 2002/0177391 | A1 | 11/2002 | Fritz | | |
| 2010/0226947 | A1 * | 9/2010 | Theberge | A61K 8/553 | 424/401 |
| 2012/0071073 | A1 * | 3/2012 | Farber | B24D 13/16 | 451/490 |
| 2018/0133867 | A1 * | 5/2018 | Chandekar | B24D 13/16 | |

* cited by examiner

ABRASIVE FLAP DISC

The object of the invention is an abrasive flap disc which is an abrasive tool for hand grinders, particularly angular ones, used in the processes of grinding and polishing of flat, curvilinear and irregular surfaces where the abrasive unit is manually pressed while being frontally positioned to an object being machined. The abrasive disc with flexible abrasive surface of abrasive flaps which adapts itself to the shape of the surface being machined is used in the machining of various metal, natural and synthetic stone, plastic, ceramic and glass objects. Most frequently for smoothing welds, bending edges, removing surface defects of castings and forgings, removing old paint coatings, rust and oxide deposits.

Abrasive flap discs have a carrying disc with flexible frontal abrasive surface formed of many abrasive flaps glued to the near-edge ring zone of the disc. The flaps trimmed out of textile weave covered with a coating of abrasive grains are fixed with their lower edges to the disc with identical angular spacings and subsequently overlapping one another in the circumferential direction in such a way that the rear edges of the flaps are exposed against the direction of rotations of the abrasive unit. The carrying disc has a form of a round wheel with a hub set off in the central zone and a coaxial hole reinforced with a steel flange sleeve through which the abrasive unit is mounted on the spindle of the grinder. The surface of the near-edge ring zone can be flat or conical. Considering the angle of application to an object being machined, the carrying discs of the abrasive flap units are loaded with complex forces, which results from principally point-wise and transversally oriented pressure bending the disc one-sidedly under the impact of force applied by an employee on the wheel external edge zone. Carrying discs are made of various materials: stainless steel, aluminium, hard composite board HDF made of pressed cellulose fibres, plastic (for example, according to the WO 0136160 description), composite material reinforced with meshes made of glass fibre and of carbon fibre (for example, according to US 2005170764). From the patent description PL/EP 1884316 and EP 0447608, there are known solutions where the carrying disc has a form of layered polymer composite with reinforcement made of meshes of glass fibre with a weight ranging from 150 to 600 [g/m$^2$] bonded by a composite matrix. The matrix contains fine cellulose waste saturated with thermosetting synthetic—phenolic, epoxy or polyester—resin or a mixture of these, wood wool, plant fibres and shredded cardboard. The disc is formed in a thermal and pressure process at a temperature ranging from 100 to 130° C. There are also known flap abrasive units presented in the descriptions EP 2433748 and U.S. Pat. No. 5,752,876 having composite carrying discs with structural reinforcement composed of many meshes of glass fibre which are situated particularly at both frontal surfaces of the carrying disc and which are bonded by a composite matrix containing synthetic resin and fine-grained material in the form of abrasive grains: corundum, silicon carbide, boron nitride or others. In such embodiment, while acquiring abrasive properties, the carrying disctakes part jointly with abrasive flaps in grinding while it wears out circumferentially and its diameter is centripetally reduced. The significantly diverse rigidity of the abrasive surfaces of the flaps and of the carrying disc, reducing the quality of the object surface, is not preferable. While grinding curvilinear surfaces to smooth them, it is important to obtain an approximately similar level of scratches on the entire surface being machined.

Flap abrasive units are fast-wearing tools; therefore, apart from meeting the required strength and the machining efficiency and quality, the material costs and the product price are also important.

The abrasive flap disc according to the invention has many technical features in common with abrasive units of the current state of the art but it stands out in that the fine-grained sand in its composite matrix is aninorganic, mineral or synthetic loose material, especially quartz, calcareous, carbonaceous or polymineral sand, industrial or quarry dusts, blast furnace or copper slag, or a mixture of these materials, with a natural or crumbled grain size ranging from 0.06 to 2.0 mm and with hardness according to the Mohs scale ranging from 3 to 7.

In a preferred embodiment of the invention, a mesh of glass fibre with paper glued to it is moulded into the upper frontal surface and bonded through the inner layer of the composite matrix with a bare mesh of glass fibre moulded into the lower frontal surface under the abrasive flaps.

It is preferred to have a layered arrangement of the carrying disc in which both meshes moulded into the frontal surfaces are adjoined from the inner side by bare meshes of glass fibre.

High rigidity of the carrying disc is demonstrated by embodiments with several bare meshes of glass fibre moulded within the inner layer of the composite matrix, each of them being separated on both sides from the adjacent meshes with composite matrix layers.

The solution of the abrasive unit according to the invention, with a carrying disc bonded with a matrix containing non-abrasive fine grains of the material, mostly with an ovoid and edgeless shape, minimises the abrasive impact of the matrix on the surface being machined. The edge-wise wear of the disc, enabling access to new and sharp grains of the flaps in a zone closer to the rotation axis, mainly consists in that grains drop off and are pulled out of the matrix, which is particularly aided by the naturally ovoid shape of sand grains. The effect is a more homogeneous roughness parameter on the ground surface.

Figure 2:
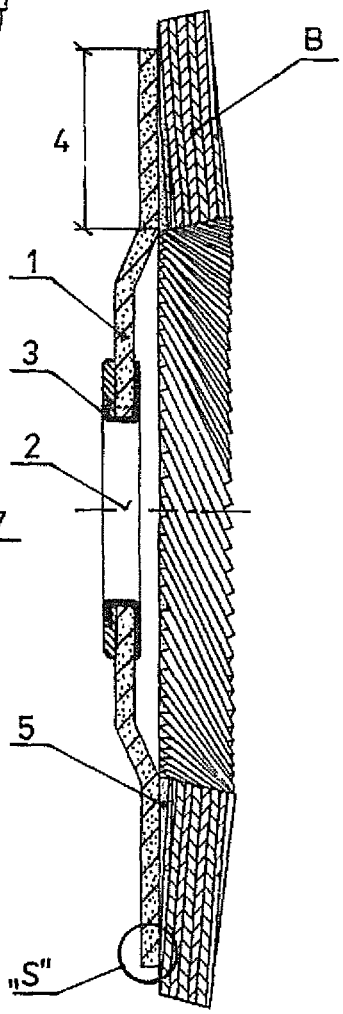
Figure 3:
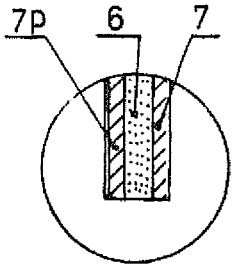
Figure 4:
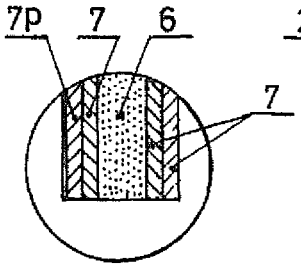
Figure 5:
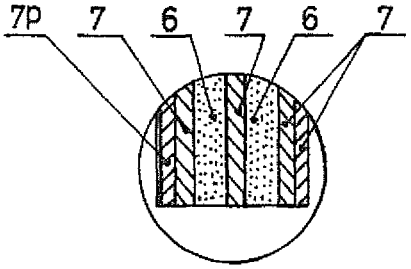

The invention is brought closer by the description of an exemplary embodiment of the abrasive flap disc shown in the drawing where FIG. 1 presents the abrasive unit in the frontal view on the working surface with abrasive flaps, FIG. 2 presents a cross-section view along the C-C line from FIG. 1 while FIGS. 3, 4 and 5 present a magnified detail "S" from FIG. 2 in three, subsequently more durable structures of the carrying disc.

The abrasive flap disc consists of two elements: a carrying disc A and a set of abrasive flaps B. The carrying disc A has a form of a round disc with a hub 1 which is set off in the central zone and in which a coaxial hole 2 is made, encased within a steel flange sleeve 3 designed for mounting the abrasive unit on the angular grinder spindle. On the frontal surface further away from the hub, the ring surface of the near-edge zone 4 is, in this case, perpendicular to the axis of rotation. In this zone, lower edges of numerous abrasive flaps B which are rectangular in this embodiment are fixed with glue bonds 5 with regular spacings of the central angle. The abrasive flaps B overlap one another subsequently in the circumferential direction in the location of the exposedrear edges. The carrying disc A has a structure of a polymer composite with structural reinforcement consisting of at least two meshes made of 7.7p glass fibre. In the embodiment shown in FIG. 3, a mesh of glass fibre with 7*p* paper glued to it is moulded into the upper frontal surface of the carrying disc A and bonded through the inner layer of the composite matrix 6 with a bare mesh of glass fibre (7)

moulded into the lower frontal surface under the abrasive flaps (B). The composite matrix 6 contains a binder of thermosetting synthetic resin, a fine-grained material and possibly conditioning additives. The subsequent FIGS. 4 and 5 of the drawing show embodiments with a higher strength, with layers of bare mesh 7 penetrable for the volume of the composite matrix 6, the layers being additionally introduced into the inner structure.

Exemplary layered structures of carrying discs and compositions of composite matrices are presented below in three exemplary embodiments.

EXAMPLE I

Layered structure of carrying disc:
steel sleeve,
bare mesh of glass fibre with paper glued to it, with a weight of 235 [g/m$^2$],
bare mesh of glass fibre with a weight of 245 [g/m$^2$],
composite mass,
bare mesh of glass fibre with a weight of 245 [g/m$^2$],
bare mesh of glass fibre with a weight of 198 [g/m$^2$],
steel sleeve.
Composite Mass:
fine-grained material: quartz sand with a medium grain size of 1.35 mm and a medium hardness of 6. according to the Mohs scale—85.0 wt. %,
SW-Supraplast 04 type liquid phenolic resin—3.5 wt. %,
MD 1/11 powder phenolic resin—11.5 wt. %.

EXAMPLE II

Layered Structure of Carrying Disc:
steel sleeve,
bare mesh of glass fibre with paper glued to it, with a weight of 235 [g/m2],
bare mesh of glass fibre with a weight of 245 [g/m2],
composite mass,
bare mesh of glass fibre with a weight of 245 [g/m2],
composite mass,
bare mesh of glass fibre with a weight of 245 [g/m2],
bare mesh of glass fibre with a weight of 198 [g/m2],
steel sleeve.
Composite Mass:
fine-grained material: quartz sand with a medium grain size of 1.35 mm and a medium hardness of 6. according to the Mohs scale—60.0 wt. %,
copper slag with an average grain size of 1.45 mm—14.60 wt. %,
SW-Supraplast 04 type liquid phenolic resin—4.75 wt. %,
MD 1/11 powder phenolic resin—12.65 wt. %,
calcium carbonate—calfix—8.00 wt. %.

The disc features increased rigidity caused by the addition of calfix and introduction of an additional mesh into the matrix layer.

EXAMPLE III

Layered Structure of Carrying Disc:
steel sleeve,
bare mesh of glass fibre with interlining glued to it, with a weight of 100 [g/m2],
bare mesh of glass fibre with a weight of 140 [g/m2],
bare mesh of glass fibre with a weight of 198 [g/m$^2$]
composite mass,
bare mesh of glass fibre with a weight of 245 [g/m2],
composite mass,
bare mesh of glass fibre with a weight of 198 [g/m2],
bare mesh of glass fibre with a weight of 198 [g/m2],
steel sleeve.
Composite Mass:
fine-grained material: quartz sand with a medium grain size of 1.35 mm and a medium hardness of 6 according to the Mohs scale.—52.70 wt. %,
copper slag with an average grain size of 1.35 mm—14.60 wt. %,
blast furnace milled slag with a grain size of 1.35 mm—7.30 wt. %,
SW-Supraplast 04 type liquid phenolic resin—4.25 wt. %,
MD 1/11 powder phenolic resin—10.75 wt. %,
red pyrite—4.00 wt. %.
barite—6.40 wt. %

A disc with 6 meshes of glass fibre, with diverse weight and weaves, bonded by a matrix with a smaller amount of the binder and filler features the required rigidity, good removal of particles from underneath the abrasive flaps, good discharge of heat and fluent wear of the carrying disc.

The invention claimed is:

1. Abrasive flap disc, containing a carrying disc (A) in a form of a round wheel with a hub (1) which is set off in the central zone and has a coaxial hole (2) reinforced with a steel flange sleeve (3) for mounting an abrasive unit on a grinder spindle, and where lower edges of numerous abrasive flaps (B) are fixed in regular angular spacings with glue binders (5) to the carrying disc (A) on a frontal ring surface of the near-edge zone (4) more distant from the hub (1), the abrasive flaps subsequently overlapping one another in the circumferential direction so that their rear edges are exposed, whereby the wheel of the carrying disc (A) is a layered polymer composite with structural reinforcement consisting of at least two meshes of glass fibre (7p,7) which are situated on both frontal surfaces of the carrying disc (A) and which are bonded by a composite matrix (6) containing a binder of a thermosetting synthetic resin and a fine-grained material, all the components of the layered composite being interconnected in the thermal-pressure process, characterised in that the fine-grained material of the composite matrix (6) is an inorganic, mineral or synthetic loose material, particularly quartz, calcareous or carbonaceous sands or polymineral sand, industrial or quarry dusts, blast furnace or copper slag, or a mixture of the aforementioned materials, whereby their natural or crumbled grain size values range from 0.06 to 2.0 mm and the hardness according to the Mohs scale ranges from 3 to 7.

2. The flap abrasive unit according to claim 1, characterised in that the composite matrix (6) of the carrying disc (A) contains 50 to 95% of fine-grained material and 5 to 50% of synthetic, particularly epoxy or polymer, resin and conditioning additives in the amount ranging from 0 to 45%, especially black or yellow pyrite, barite, calcium carbonate, zinc sulphide and potassium fluoroborate.

3. The flap abrasive unit according to claim 1, characterised in that a mesh of glass fibre with paper glued (7p) to it is moulded into the upper frontal surface and bonded through the inner layer of the composite matrix (6) with a bare mesh of fibre glass (7) moulded into the lower frontal surface under the abrasive flaps (B).

4. The flap abrasive unit according to claim 3, characterised in that both meshes (7p, 7)moulded into the frontal surfaces are adjoined from the inner side by bare meshes of fibre glass (7).

5. The flap abrasive unit according to claim 4, characterised in that in the inner layer of the composite matrix (6)

there is moulded at least one bare mesh of fibre glass (7), separated on both sides from the adjacent ones by layers of the composite matrix (6).

* * * * *